US012048374B2

(12) United States Patent
Albers et al.

(10) Patent No.: US 12,048,374 B2
(45) **Date of Patent: *Jul. 30, 2024**

(54) MOBILE WORKSTATION WITH ADJUSTABLE HEIGHT

(71) Applicant: Midmark Corporation, Versailles, OH (US)

(72) Inventors: Daniel A. Albers, New Weston, OH (US); Connor James Osowski, Dayton, OH (US); Jeffrey T. DeBord, Worthington, OH (US); Rainer Bernhard Teufel, Worthington, OH (US); Todd Linthicum, Bexley, OH (US); Jay F. Perkins, Pickerington, OH (US); David Simpson, Worthington, OH (US); Nicholas Leonard Blackburn, Wellesley (CA); Jon Robert Neil Hamilton, Kitchener (CA); Michael C. Couch, Troy, OH (US); Darin Gregory Whittington, Versailles, OH (US)

(73) Assignee: Midmark Corporation, Versailles, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/077,825

(22) Filed: Dec. 8, 2022

(65) Prior Publication Data

US 2023/0101727 A1 Mar. 30, 2023

Related U.S. Application Data

(63) Continuation of application No. 17/025,650, filed on Sep. 18, 2020, now Pat. No. 11,547,207, which is a (Continued)

(51) Int. Cl.
*A47B 21/02* (2006.01)
*A47B 9/12* (2006.01)

(Continued)

(52) U.S. Cl.
CPC ..... *A47B 21/02* (2013.01); *A47B 9/12* (2013.01); *A47B 9/20* (2013.01); *A47B 13/023* (2013.01);

(Continued)

(58) Field of Classification Search
CPC .. A47B 21/02; A47B 9/12; A47B 9/20; A47B 13/023; A47B 21/04; A47B 21/06; A47B 2013/025

(Continued)

(56) References Cited

U.S. PATENT DOCUMENTS 5,114,109 A 5/1992 Fitz et al.
5,129,611 A 7/1992 Grover et al.

(Continued)

FOREIGN PATENT DOCUMENTS

WO WO 1999/019247 A1 4/1999
WO WO 2017/079917 A1 5/2017

OTHER PUBLICATIONS

International Search Report and Written Opinion dated Nov. 8, 2019, for International Application No. PCT/US2019/050368, 9 pages.

*Primary Examiner* — Daniel J Troy
*Assistant Examiner* — Timothy M Ayres
(74) *Attorney, Agent, or Firm* — Frost Brown Todd LLP

(57) ABSTRACT

A mobile workstation with adjustable height of the present disclosure may comprise a top assembly, an adjustment assembly, and a bottom assembly. Adjustment assembly may comprise telescopically engaged segments. One or more pulleys or pulley assemblies may be disposed within one or (Continued)

more of the segments to allow for withdrawing and retracting segments from one another at the same rate. Actuation of the raising or lowering of the overall height of the mobile workstation may be realized through either a manual actuation or an electronic element such as a linear actuator.

15 Claims, 12 Drawing Sheets

Related U.S. Application Data continuation of application No. 16/566,224, filed on Sep. 10, 2019, now Pat. No. 10,813,450.

(60) Provisional application No. 62/729,705, filed on Sep. 11, 2018.

(51) Int. Cl.

| | |
|---|---|
| ***A47B 9/20*** | (2006.01) |
| *A47B 13/02* | (2006.01) |
| *A47B 21/04* | (2006.01) |
| *A47B 21/06* | (2006.01) |

(52) U.S. Cl.
CPC ..... *A47B 2013/025* (2013.01); *A47B 21/04* (2013.01); *A47B 21/06* (2013.01)

(58) Field of Classification Search
USPC ..... 108/147; 312/331
See application file for complete search history.

(56) References Cited

U.S. PATENT DOCUMENTS

| | | | | |
|---|---|---|---|---|
| 5,289,782 | A * | 3/1994 | Rizzi | A47B 9/02 248/162.1 |
| 5,421,481 | A | 6/1995 | Fortmann et al. | |
| 7,128,003 | B2 | 10/2006 | Okninski | |
| 7,185,868 | B2 | 3/2007 | Wang | |
| 7,658,359 | B2 * | 2/2010 | Jones | A47B 9/20 248/162.1 |
| 8,096,007 | B2 | 1/2012 | Dyreby et al. | |
| 8,117,931 | B2 | 2/2012 | Stoelinga | |
| 8,342,465 | B2 | 1/2013 | Koder | |
| 9,232,855 | B2 | 1/2016 | Ergun et al. | |
| 9,462,881 | B2 | 10/2016 | Wang | |
| 9,572,422 | B2 | 2/2017 | Ergun et al. | |
| 9,743,754 | B2 | 8/2017 | Ergun et al. | |
| 9,814,306 | B2 | 11/2017 | Koder et al. | |
| 10,813,450 | B2 * | 10/2020 | Albers | A47B 21/02 |
| 11,547,207 | B2 * | 1/2023 | Albers | A47B 9/20 |
| 2006/0156837 | A1 | 7/2006 | Stoelinga | |
| 2009/0249905 | A1 | 10/2009 | Chen et al. | |
| 2015/0047538 | A1 * | 2/2015 | Ergun | A47B 9/02 248/188.5 |
| 2015/0285430 | A1 | 10/2015 | Wang | |

* cited by examiner

MOBILE WORKSTATION WITH ADJUSTABLE HEIGHT

BACKGROUND

Mobile workstations have become an important component of the modern hospital setting by increasing flexibility and portability as staff care for patients. Workstations that have computers can be shared between health care professionals to save money and space as well as promote interprofessional collaboration. Naturally, different individuals using the mobile workstation prefer different heights for the tabletop area of the workstation and/or the monitor. Thus, vertical adjustment may be provided in some mobile workstations. However, this vertical adjustment is often not provided with sufficient adjustment range to accommodate the varying heights of different users. Also, if not properly designed, vertical adjustment may result in a mobile workstation that is shaky and mis-balanced while raising and lowering of the top assembly and which, in turn, may shake loose or otherwise disrupt the contents of the top workstation surface and/or the computer system. Thus, a need in the field exists for a mobile workstation which provides a broad range of vertical adjustment and also smoothly and steadily raises and lowers to fit the needs of a user.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
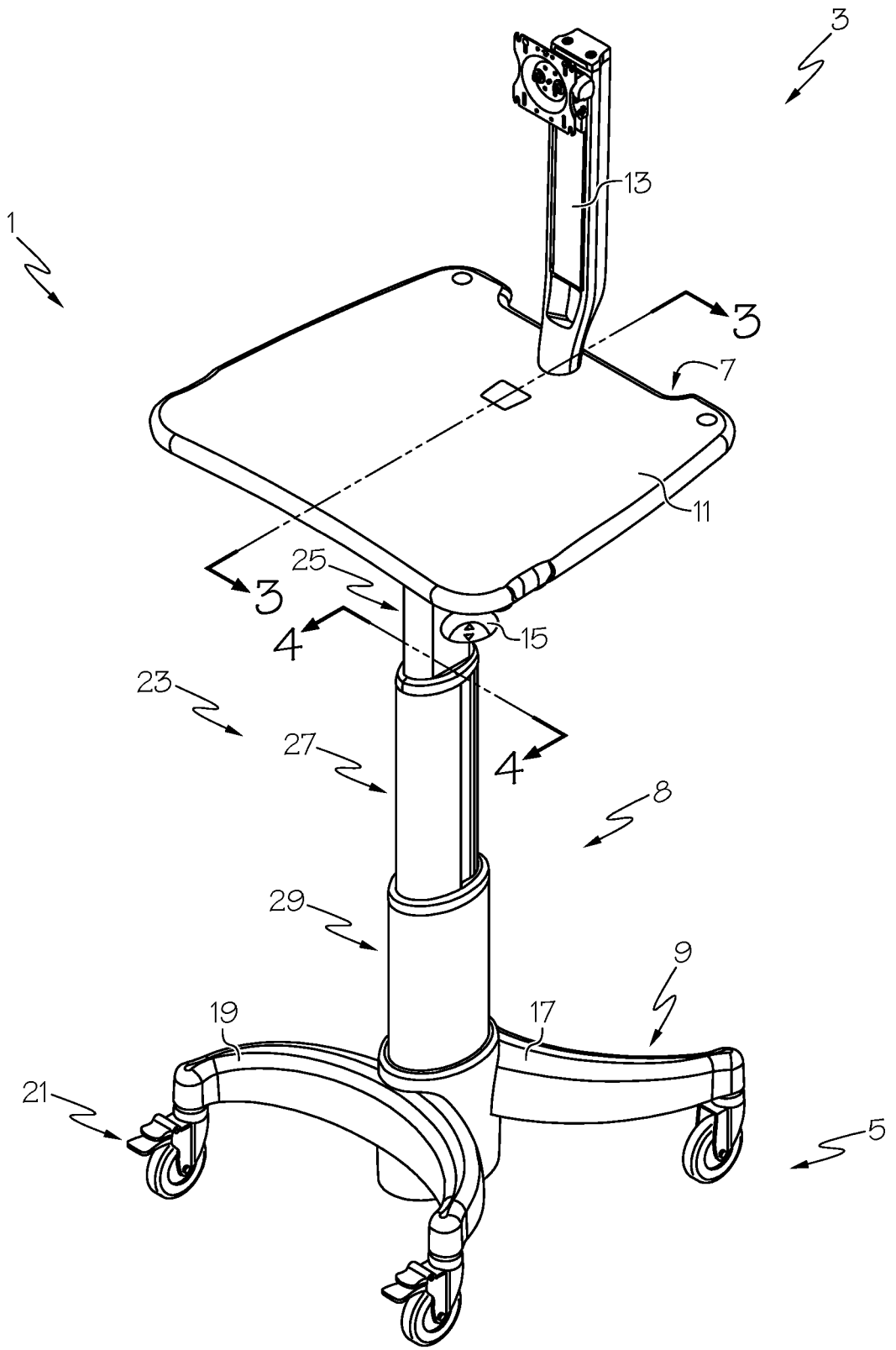
FIG. 1 depicts a perspective view of an exemplary mobile workstation with adjustable height in a raised or first position and further depicts the telescopic engagement between an exemplary middle shaft segment of the mobile workstation with an exemplary bottom shaft segment of the mobile workstation, as well as the telescopic engagement between an exemplary top shaft segment of the mobile workstation and the middle shaft segment.
Figure 2:
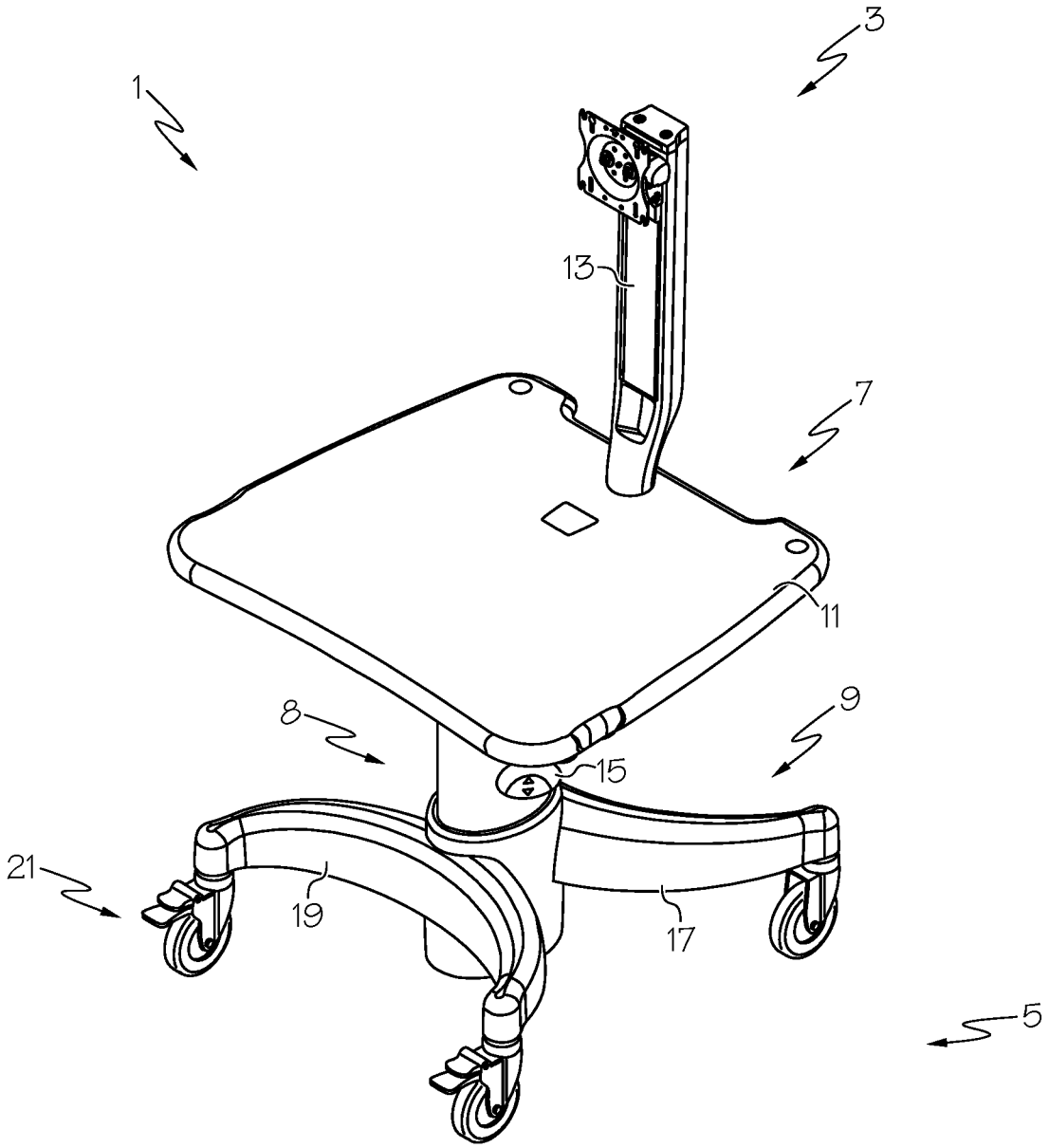
FIG. 2 depicts a perspective view of the mobile workstation of FIG. 1 in a lowered or second position.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, versions, examples, etc. described herein may be combined with any one or more of the other teachings, expressions, versions, examples, etc. that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. Mobile Workstation with Mechanical Adjustable Height

An exemplary mobile workstation with mechanical adjustable height (1) is depicted in FIGS. 1-10 and described herein. Mobile workstation with mechanical adjustable height (1), referred to hereinafter as mobile workstation (1), extends from a first end (3) to a second end (5). A top assembly (7) is disposed at first end (3) and a bottom assembly (9) is disposed at second end (5). Top assembly (7) includes a table element (11) and a monitor stand (13). Bottom assembly (9) includes a base bracket (17) having four arms (19), with each arm configured to receive a portion of a wheel assembly (21) therein.

Mobile workstation (1) further includes an adjustment assembly (8). Adjustment assembly (8) is configured to selectively change the distance between top assembly (7) and bottom assembly (9). Adjustment assembly (8) includes an adjustment lever (15) in cooperation with an adjustment shaft (23). Adjustment lever (15) is secured to table element (11) of top assembly (7). Adjustment shaft (23) extends from top assembly (7) to bottom assembly (9). Adjustment shaft (23) is comprised of a top shaft segment (25), a middle shaft segment (27), and a bottom shaft segment (29). Adjustment shaft (23) allows for adjusting the vertical height of mobile workstation (1) greater than 25 inches between a raised position (FIG. 1) and a lowered position (FIG. 2) with the option to lock adjustment shaft (23) at any height therebetween and as desired by the user. Height adjustment is facilitated by a user grasping onto table element (11) and actuating adjustment lever (15) to release adjustment shaft (23) from a locked state and allow the user to push or pull table element (11) to raise or lower top assembly (7) as desired. Previous height adjustment features for certain mobile workstations similar to mobile workstation (1) did not allow for a total vertical adjustment range greater than 25 inches, as the length of the mechanisms and internal features were a limiting factor in allowing a workstation to achieve this range of vertical adjustment. As will be disclosed herein, mobile workstation (1) overcomes this limitation through a novel approach to workstation design.

In some versions of mobile workstation (1), middle shaft segment (27) is telescopically engaged with bottom shaft segment (29), and top shaft segment (25) is telescopically engaged with middle shaft segment (27). The telescopic engagement between middle shaft segment (27) and bottom shaft segment (29) allows for at least a portion of middle shaft segment (27) to slide or translate into and out of bottom shaft segment (29). Similarly, the telescopic engagement between top shaft segment (25) and middle shaft segment (27) allows top shaft segment (25) to slide or translate into and out of middle shaft segment (27).

Several plates are disposed in adjustment assembly (8) for use in securing various features or adding generally horizontal platform elements within shaft segments. Top shaft segment (25) comprises an upper plate (43), wherein upper plate (43) is movably disposed within middle shaft segment (27). Middle shaft segment comprises a middle plate (34), wherein middle plate (34) is movably disposed within bottom shaft segment (29). Bottom shaft segment (29) comprises a lower plate (63).

Figure 3:
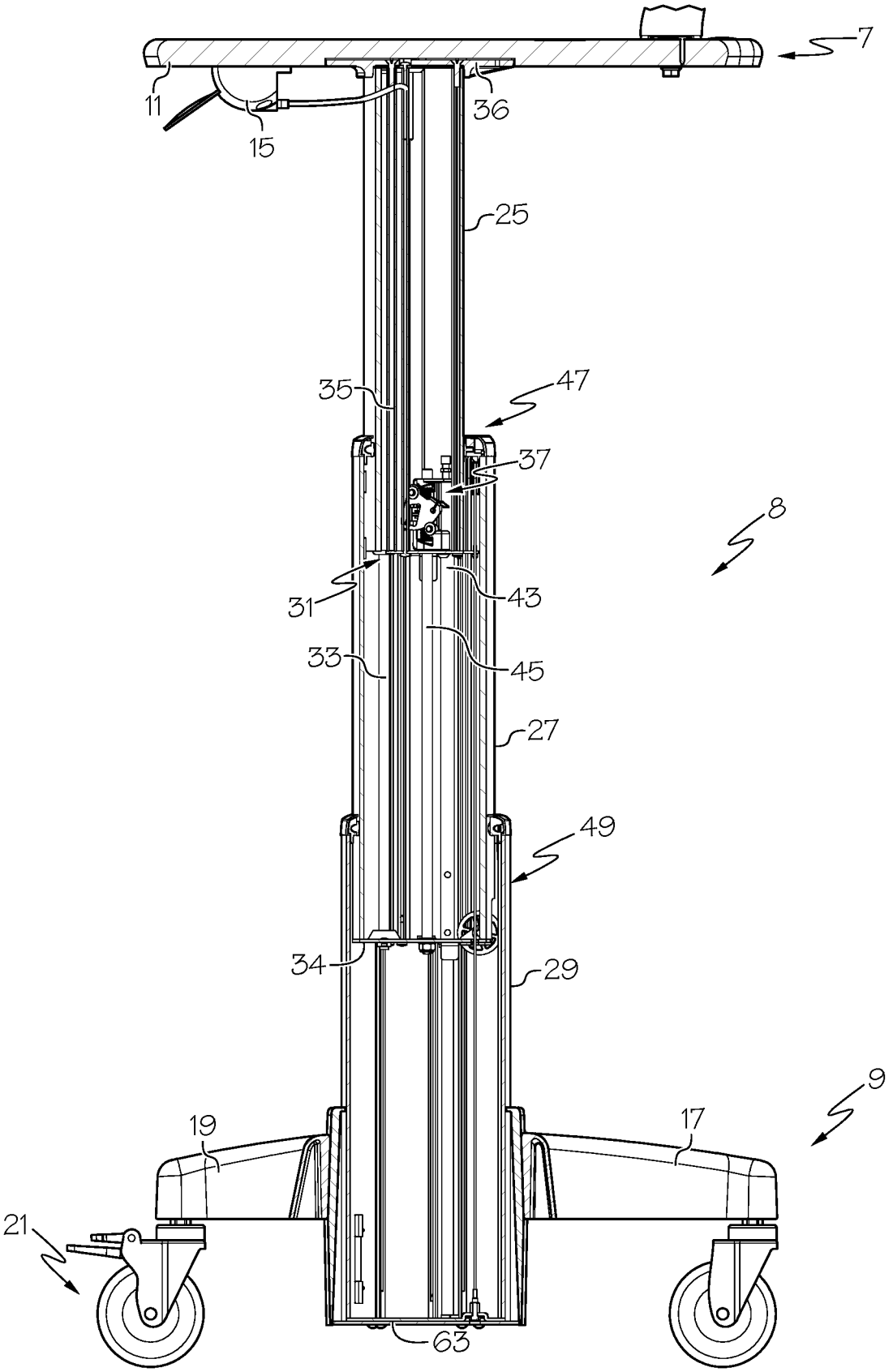
FIG. 3 depicts a cross-sectional view taken along line 3-3 of FIG. 1.

In some versions of mobile workstation (1), a biasing element (31) is disposed internal to adjustment shaft (23) and configured to bias top assembly (7) and bottom assembly (9) either towards one another or away from one another. Biasing elements may take many forms including, but not limited to, various types of springs elements such as coil springs or gas springs, actuators, counterweights, and the like. As shown in FIG. 3, biasing element (31) comprises a gas spring having a piston rod (33) working in conjunction with a pressurized cylinder (35) and configured to bias top assembly (7) away from bottom assembly (9). More specifically, biasing element (31) is configured to bias top assembly (7) away from middle plate (34). The exposed end of piston rod (33) is secured to middle plate (34) disposed in adjustment shaft (23), while the end of cylinder (35) is secured to cap plate (36) located at the uppermost end of top shaft segment (25) of adjustment shaft (23).

Figure 8:
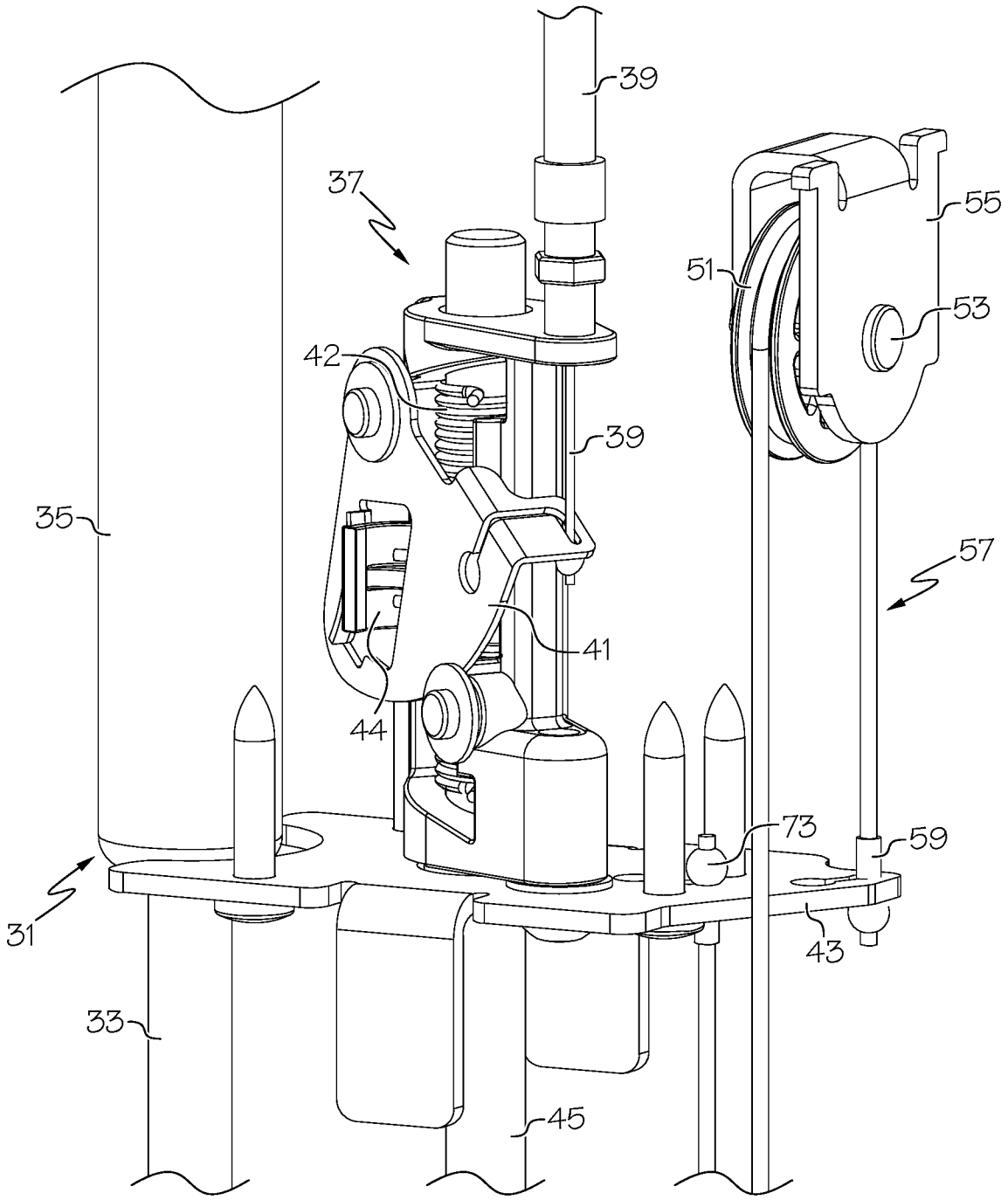
FIG. 8 depicts a perspective view of an exemplary upper plate of the mobile workstation of FIG. 1.

As shown in FIGS. 3 and 8, adjustment shaft (23) may be selectively locked at a desired vertical height by engaging a lock assembly (37) coupled with adjustment lever (15) of mobile workstation (1). Some versions of lock assembly (37) include a lock actuation cable (39) extending from adjustment lever (15) on one end and connected with a lock plate (41) at the opposite end. Adjustment lever (15) may be actuated to move lock plate (41) between a first position and a second position. For example, when adjustment lever (15) is actuated by manual depression, lock plate (41) moves to a second position. When adjustment lever (15) is released and undepressed, lock plate (41) moves to the first position.

Lock plate (41) is secured to upper plate (43), either directly or indirectly. Upper plate (43) caps the lower end of top shaft segment (25) and defines an internal aperture (not shown) having an adjustment rod (45) slidably extending therethrough. When lock plate (41) is in the first position, a brake is actuated to clamp onto adjustment rod (45) and prevent adjustment rod (45) from sliding relative upper plate (43). In the embodiment of the present invention shown in FIG. 8, the brake comprises a wrap-spring style brake in which a brake spring (42) is helically coiled about adjustment rod (45) and is sized in such a way that the inside diameter of the brake spring (42) creates an interference fit around adjustment rod (45), which fit restricts movement of adjustment rod (45) through brake spring (42) coils and results in a user being unable to adjust the height of the top assembly when lock plate (41) is in first position. When adjustment lever (15) is actuated by a user, lock actuation cable (39) causes lock plate (41) to move to the second position. As lock plate (41) moves to second position, it engages with the brake release tab (44), which, in turn, causes the coils of brake spring (42) to uncoil slightly and results in an increase in brake spring (42) inner diameter sufficient to allow adjustment rod (45) to move freely through the coils of brake spring (42). It will be noted that use of the above-described wrap-spring style brake as an approach to controlling vertical movement of the adjustment shaft (23) is advantageous in that it effectively allows for an infinite number of adjustment positions within the range of adjustment provided by the adjustment shaft (23) and does not force a user to select from a finite number of discretized adjustment positions.

Inasmuch as some versions of biasing element (31) bias adjustment shaft (23) in the raised position (FIG. 1), releasing lock plate (41) to allow adjustment rod (45) to slide within lock assembly (37) acts to raise adjustment shaft (23) toward the raised position with little or no external force from the user. If the user wishes to move adjustment shaft (23) toward the lowered position, the user simply applies downward pressure on top assembly (7) while actuating adjustment lever (15) to direct adjustment shaft (23) toward the lowered position. By releasing adjustment lever (15) and allowing lock plate (41) to lock adjustment rod (45) from sliding within lock assembly (37) the overall height of mobile workstation (1) is adjusted to the user's preference.

Adjustment assembly (8) includes an upper pulley assembly (47) and a lower pulley assembly (49). Upper pulley assembly (47) and lower pulley assembly (49) are disposed internally to adjustment shaft (23) and work in cooperation to raise and lower top shaft segment (25) and middle shaft segment (27) of adjustment shaft (23) proportionally to one another and/or at the same rate. Top shaft segment (25) is translated into and drawn out of middle shaft segment (27) at generally the same rate and ratio as middle shaft segment (27) is translated into and drawn out of bottom shaft segment (29).

Figure 9:
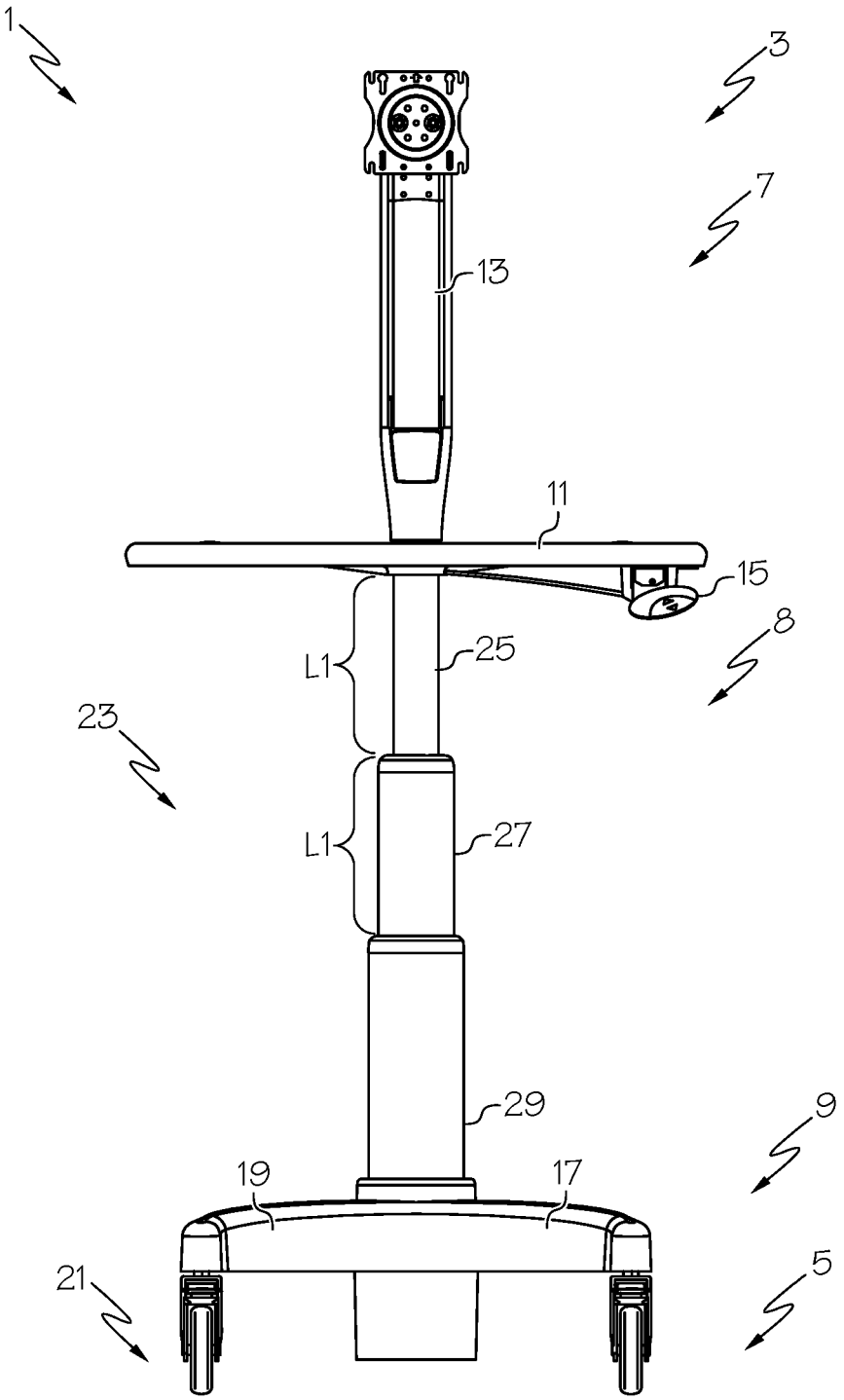
FIG. 9 depicts a perspective view of the mobile workstation of FIG. 1.

As can be seen in FIG. 9, one portion of top shaft segment (25) is retracted into middle shaft segment (27) while the remaining portion of top shaft segment (25) is exposed at a length of L1. Similarly, in FIG. 9, one portion of middle shaft segment (27) is retracted into bottom shaft segment (29) while the remaining portion of middle shaft segment (27) is exposed, also at a length of L1.

Figure 10:
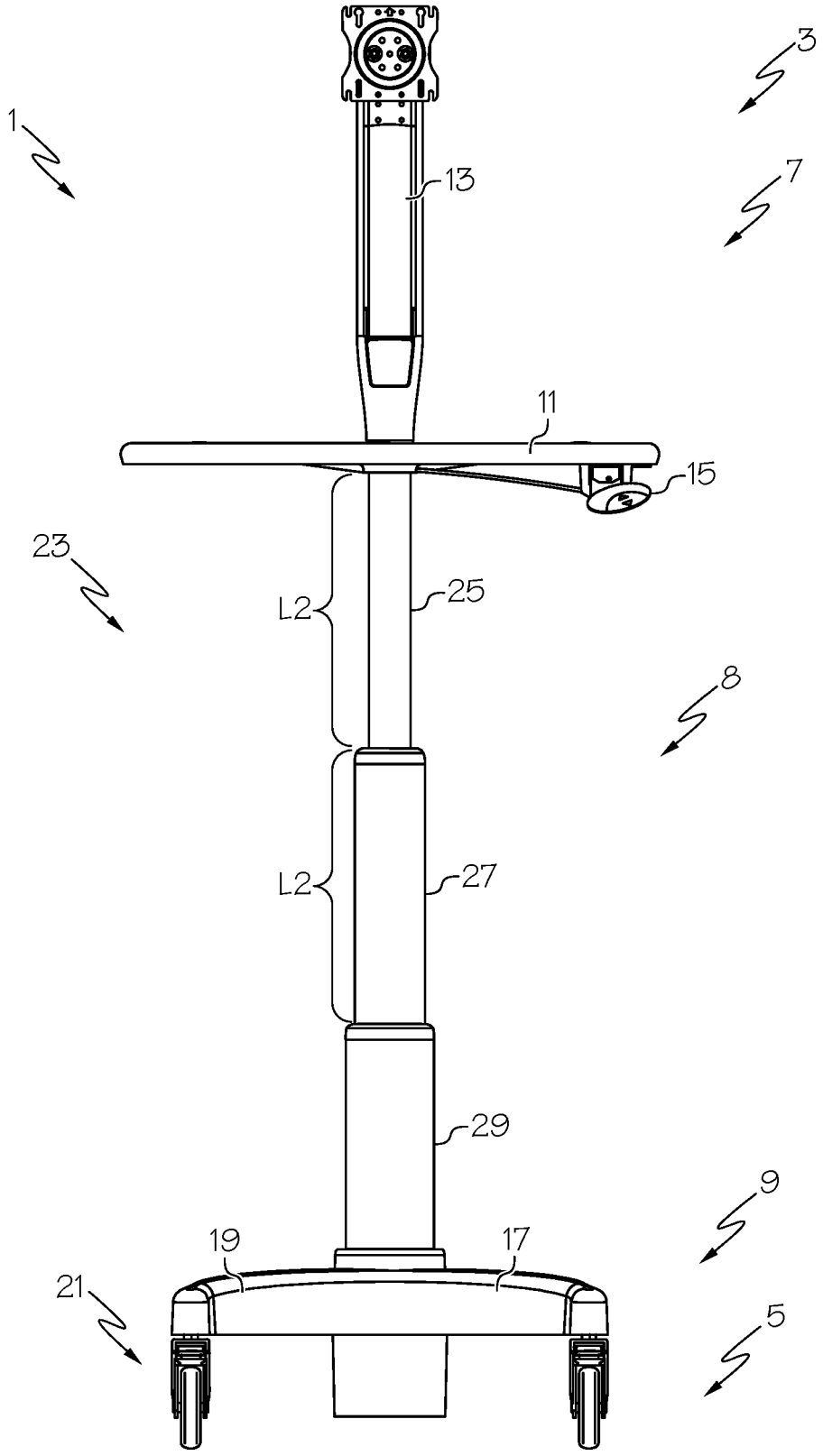
FIG. 10 depicts another perspective view of the mobile workstation of FIG. 1.

As can be seen in FIG. 10, mobile workstation (1) has been elevated with respect to FIG. 9. In FIG. 10, one portion of top shaft segment (25) is retracted into middle shaft segment (27) while the remaining portion of top shaft segment (25) is exposed at a length of L2. Similarly, in FIG. 10, one portion of middle shaft segment (27) is retracted into bottom shaft segment (29) while the remaining portion of middle shaft segment (27) is exposed, also at a length of L2.

By incorporating upper pulley assembly (47) and lower pulley assembly (49) into adjustment shaft (23), top shaft segment (25) and middle shaft segment (27) either retracts or is withdrawn at the same rate when adjustment shaft (23)

is raised or lowered by the user. This feature increases overall stability in mobile workstation (1) as top shaft segment (25) and middle shaft segment (27) stay nested and sheathed within the adjacent segment proportionally, rather than one segment fully extended with the remaining segment fully nested or sheathed.

Figure 4:
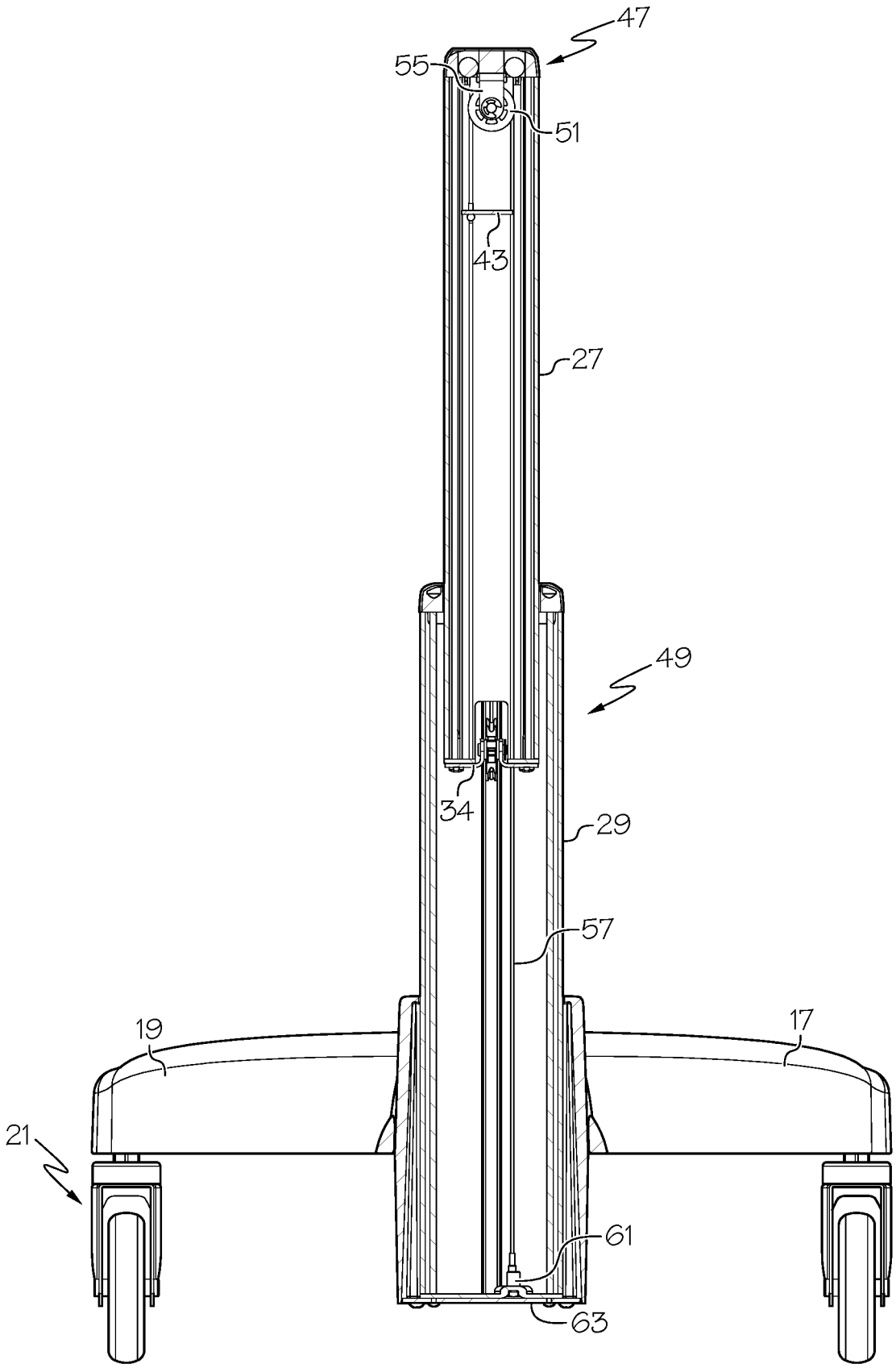
FIG. 4 depicts a cross-sectional view taken along line 4-4 of FIG. 1.
Figure 5:
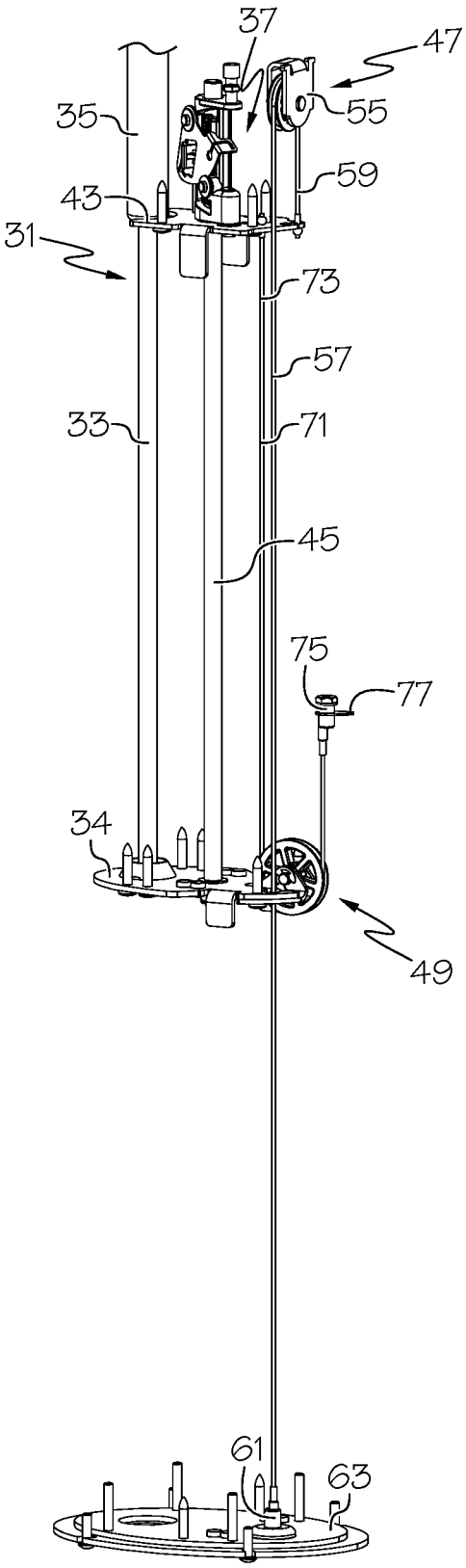
FIG. 5 depicts a perspective view of various internal components of the mobile workstation of FIG. 1.
Figure 6:
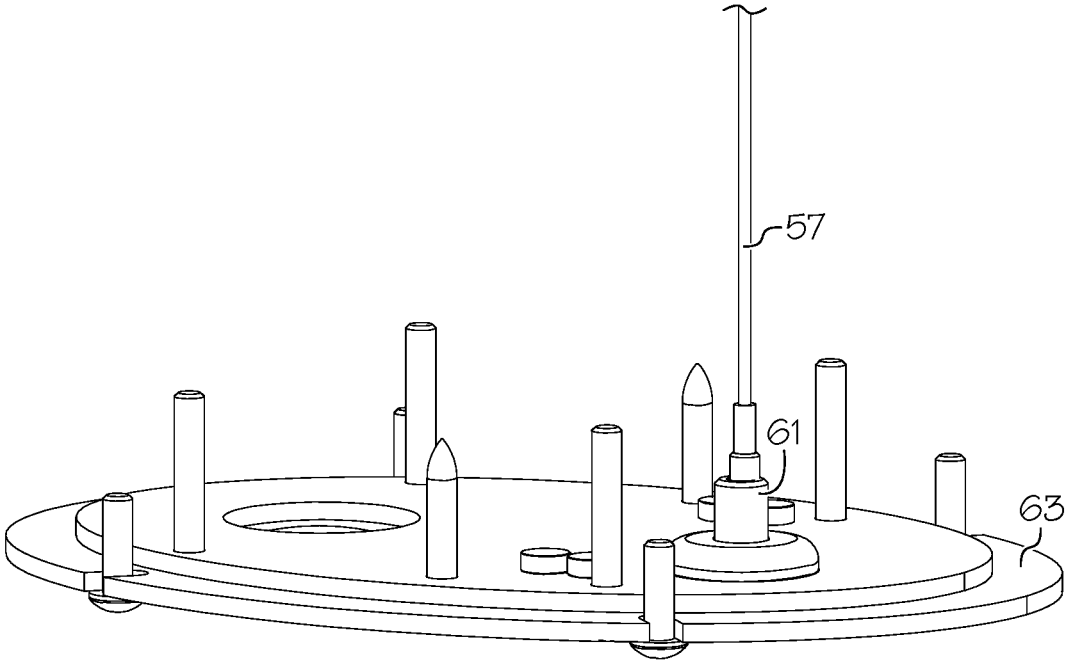
FIG. 6 depicts a perspective view of an exemplary lower plate of the mobile workstation of FIG. 1.

To achieve this, as shown in FIGS. 5 and 8, upper pulley assembly (47) includes an upper pulley (51) rotatable about a shaft (53) and fixed within a bracket (55). As shown in FIG. 4, bracket (55) is secured to middle shaft segment (27). Upper pulley assembly (47) further includes a cable (57) extending from a first end (59) to a second end (61). First end (59) of cable (57) is secured to top shaft segment (25) and more specifically to upper plate (43) of top shaft segment (25), while second end (61) of cable (57) is secured to bottom shaft segment (29) and more specifically to lower plate (63) of bottom shaft segment (29) to indirectly connect upper plate (43) and lower plate (63). Cable (57) extends from lower plate (63), through middle plate (34), through upper plate (43), around upper pulley (51), and has first end (59) secured to upper plate (43). Inasmuch as upper plate (43) is movably disposed within middle shaft segment (27), as upper plate (43) moves toward lower plate (63), cable (57) passes around upper pulley (51) to maintain the connection and tension between upper plate (43) and lower plate (63).

Figure 7:
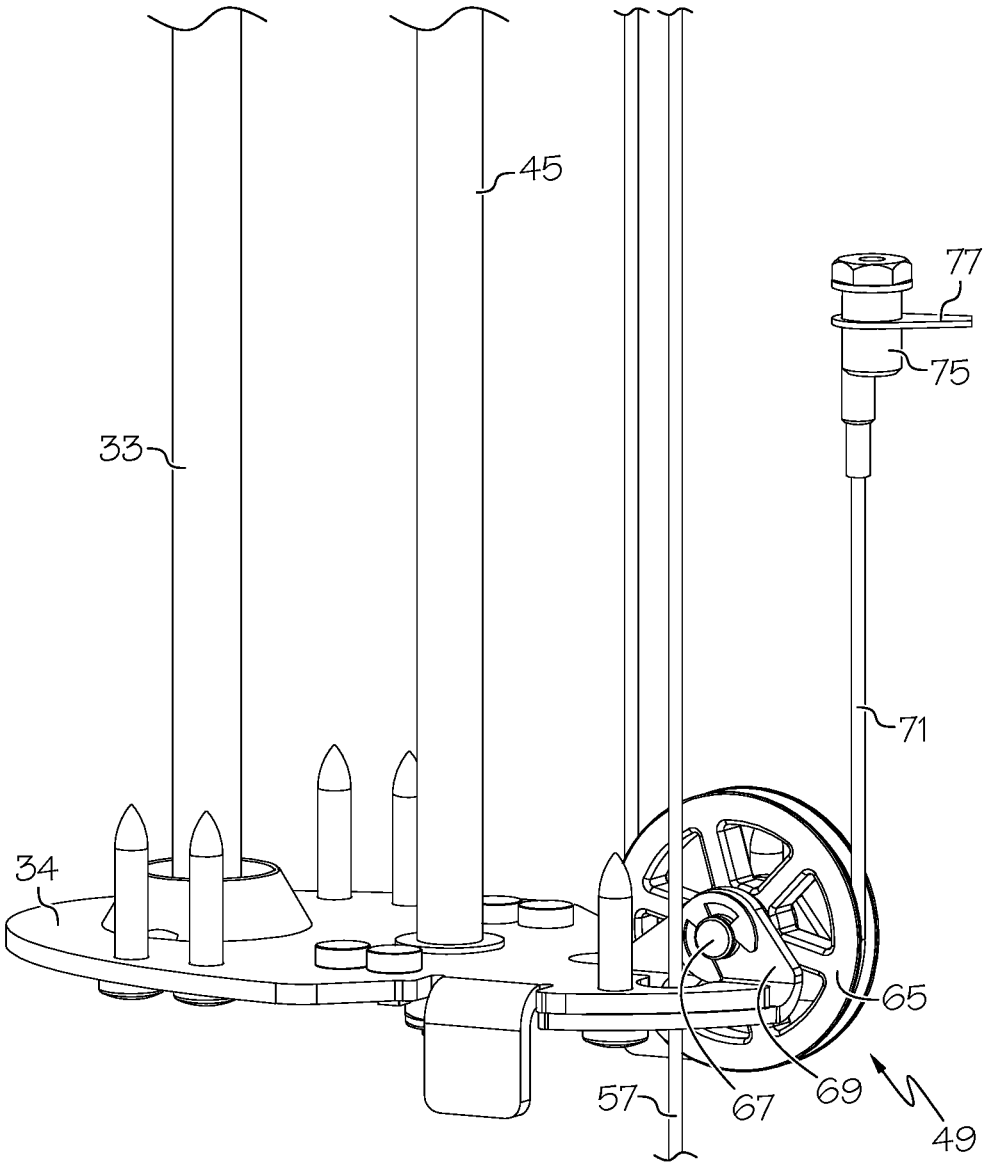
FIG. 7 depicts a perspective view of an exemplary middle plate of the mobile workstation of FIG. 1.

As shown in FIGS. 5 and 7, lower pulley assembly (49) is similar in many respects to upper pulley assembly (47) and includes a lower pulley (65) rotatable about a shaft (67) and fixed within a bracket (69) secured to or otherwise associated with middle plate (34). Lower pulley assembly (49) further includes a cable (71) extending from a first end (73) to a second end (75). In general, first end (73) of cable (71) is secured to top shaft segment (25) while second end (75) of cable (71) is secured to bottom shaft segment (29). More specifically, first end (73) of cable (71) is secured to upper plate (43) of top shaft segment (25), while second end (75) of cable (71) is secured to a bracket (77) of uppermost portion of bottom shaft segment (29). Cable (71) extends from upper plate (43) down to middle plate (34) and around lower pulley (65) to the bracket (77). As upper plate (43) moves toward middle plate (34), cable (71) passes lower pulley (65) to maintain the connection and tension between upper plate (43) and middle plate (34).

In operation, to lower mobile workstation (1) from a fully raised position (FIG. 1) to a fully lowered position (FIG. 2), a user actuates adjustment lever (15) to move lock actuation cable (39) and release lock assembly (37), whereby the lock between lock assembly (37) and adjustment rod (45) is released. Upon release of the lock between lock assembly (37) and adjustment rod (45), top assembly (7) is free to move vertically with respect to bottom assembly (9). Inasmuch as top assembly (7) and bottom assembly (9) are biased apart via biasing element (31), the user must press down upon top assembly (7) to lower top assembly (7) toward bottom assembly (9). Pressing upon top assembly (7) pushes downwardly on cylinder (35) and piston rod (33) of biasing element (31). This in turn pushes middle plate (34) downwardly, actuating lower pulley assembly (49) by passing cable (71) about lower pulley (65). As cable (71) passes about lower pulley (65), first end (73) of cable (71) pulls upper plate (43) downwardly at the same rate as middle plate (34) is being pushed downwardly. Additionally, applying downward force to top assembly (7) also pushes downwardly on upper plate (43). Downward force on upper plate (43) actuates upper pulley assembly by passing cable (57) about upper pulley (51). As cable (57) passes about upper pulley (51) second end (61) of cable (57) pulls upper plate (43) downwardly. Through this arrangement of pulley assemblies (47, 49) and biasing element (31), middle shaft segment (27) is proceeds downwardly into bottom shaft segment (29) at the same rate or ratio as top shaft segment (25) proecceds downwardly into middle shaft segment (27) by the user with the same general exposed length of segments (25, 27) as mobile workstation (1) is raised and lowered.

Conversely, to raise mobile workstation (1) from a fully lowered position (FIG. 2) to a fully raised position (FIG. 1), the user actuates adjustment lever (15) to move lock actuation cable (39) and release lock assembly (37). Upon release of lock assembly (37), top assembly (7) is free to move in a vertical orientation and relative to bottom assembly (9). Inasmuch as top assembly (7) is biased to the fully raised position (FIG. 1) via biasing element (31), the user simply has to continue to actuate adjustment lever (15) while applying little or no upward pressure to top assembly (7) to facilitate raising top assembly (7). Pursuant to this raising of top assembly (7), biasing element (31) expands to move upper plate (43) away from middle plate (34) through extension of piston rod (33) out of cylinder (35). In turn, cable (71) passes around lower pulley (65) to expand the proximity of upper plate (43) with respect to middle plate (34). Thus, top shaft segment (25) raises out of middle shaft segment (27) at generally the same rate or ratio as middle shaft segment (27) raises out of bottom shaft segment (29).

One advantage of the use of multiple pulley assemblies is that one can obtain a greater range of vertical adjustment for the mobile workstation while relying on only a single biasing element (31). In some versions of mobile workstation (1), the top surface of top assembly (7) is movable for a total vertical range of about 26 inches, which is significantly greater than the range of movement most commonly offered by existing workstation resellers and is advantageous since it allows comfortable workstation use by a broader range of users. In some versions of mobile workstation (1), the top surface of top assembly (7) is movable between about 23 inches off the floor surface to about 49 inches off the floor surface.

As described above, some versions of mobile workstation (1) comprise top assembly (7), base assembly (9), and adjustment assembly (8) configured to selectively change the distance between top assembly (7) and base assembly (9). Some versions of adjustment assembly (8) comprise bottom shaft segment (29), wherein bottom shaft segment (29) is secured to base assembly (9). Some versions of adjustment assembly (8) comprise middle shaft segment (27), wherein middle shaft segment (27) is telescopically engaged with bottom shaft segment (29). Some versions of adjustment assembly (8) comprise top shaft segment (25), wherein top shaft segment (25) is secured to top assembly (7) and wherein top shaft segment (25) is telescopically engaged with middle shaft segment (27). Some versions of adjustment assembly (8) comprise upper pulley assembly (27). Some versions of adjustment assembly (8) comprise lower pulley assembly (49). Some versions of adjustment assembly (8) comprise a pulley, such as upper pully (51) or lower pully (65). Some versions of adjustment assembly (8) comprise a cable, such as first cable (57) or second cable (71), wherein the cable extends from a first end to a spaced apart second end, and wherein the cable is engaged with the pulley.

The descriptions, features, and examples provided herein illustrate a method comprising actuating adjustment assembly (8) of mobile workstation (1) to reduce a distance between top assembly (7) and base assembly (9) by retracting top shaft segment (25) of adjustment assembly (8) into middle shaft segment (27) of adjustment assembly (8) at a retract rate and simultaneously retracting middle shaft segment (27) into bottom shaft segment (29) of adjustment assembly (8) at the same retract rate.

II. Mobile Workstation with Electrical Adjustable Height

Figure 11:
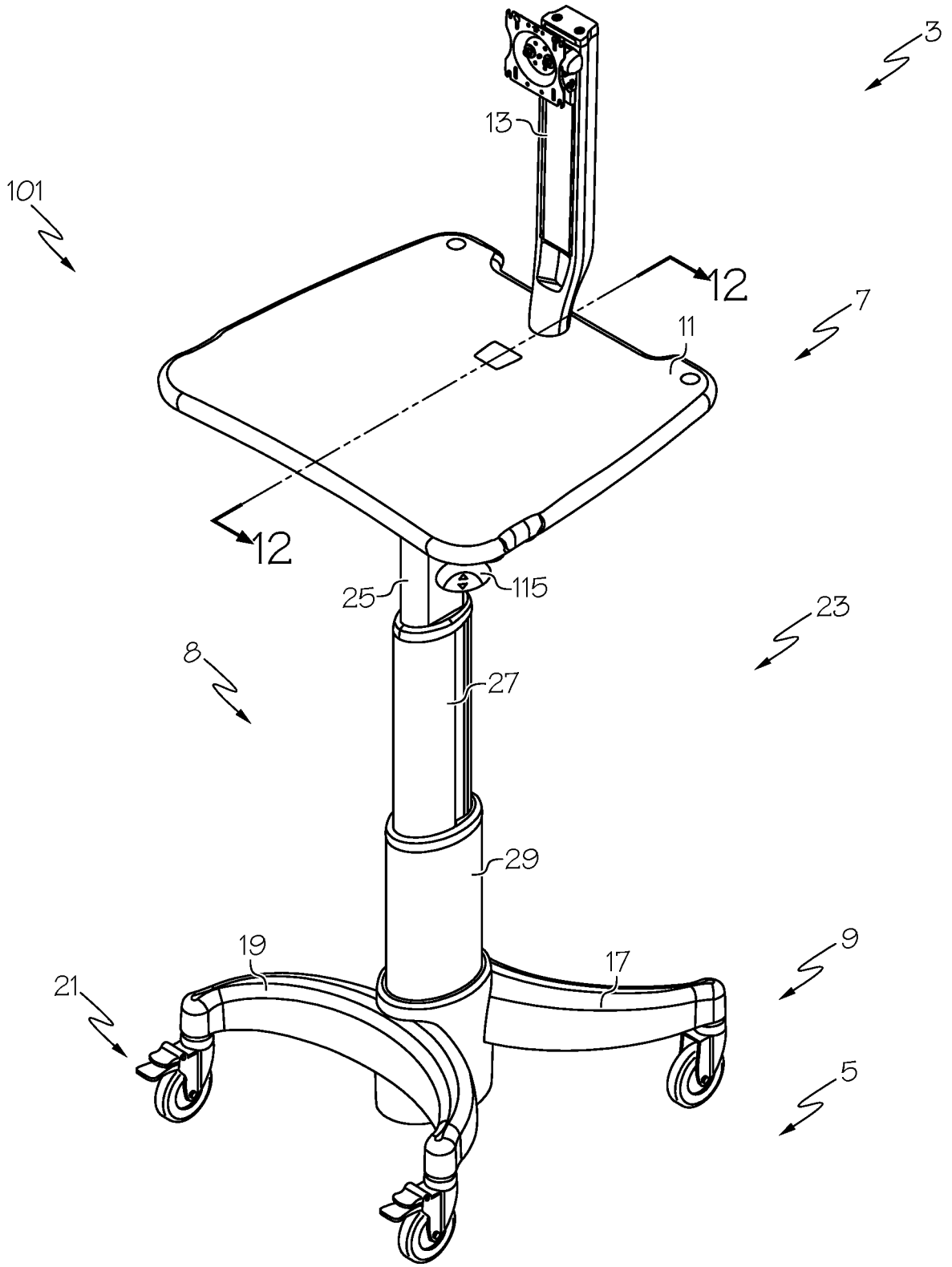
FIG. 11 depicts a perspective view of another exemplary mobile workstation with adjustable height in a raised or first position and further depicts the telescopic engagement between an exemplary middle shaft segment of the mobile workstation with an exemplary bottom shaft segment of the mobile workstation, as well as the telescopic engagement between an exemplary top shaft segment of the mobile workstation and the middle shaft segment.
Figure 12:
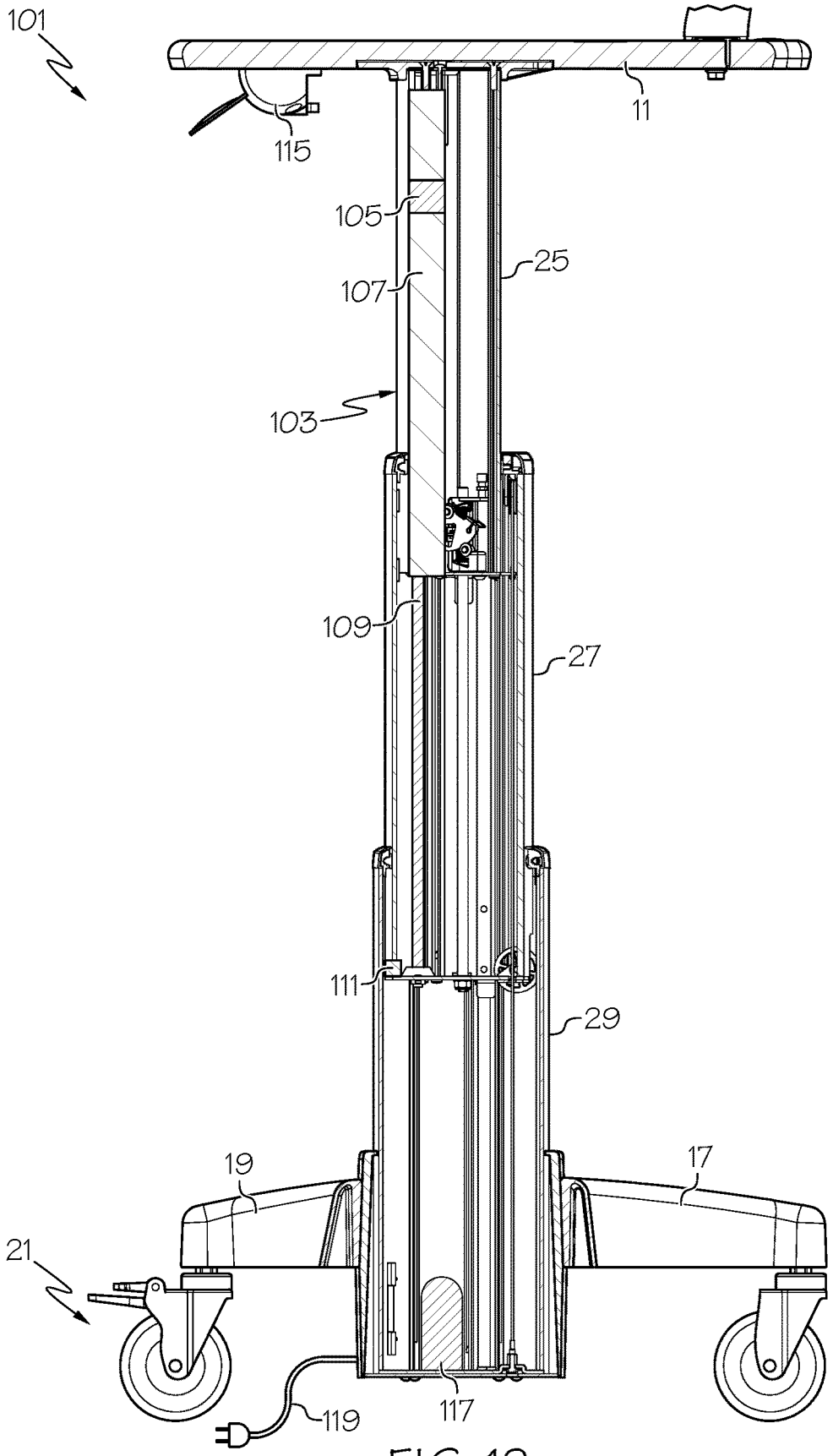
FIG. 12 depicts a cross-sectional view taken along line 12-12 of FIG. 11.

An exemplary mobile workstation with electrical adjustable height (101) is depicted in FIGS. 11 and 12 and described herein. Mobile workstation with electrical adjustable height (101), referred to hereinafter as mobile workstation (101), is similar to mobile workstation (1) in most respects. However, mobile workstation (101) includes a linear actuator (103) rather than the mechanical structures such as the biasing element (31) described above with respect to mobile workstation (1).

As shown in FIGS. 11 and 12, linear actuator (103) includes an adjustment element (115), which may be in the form of a toggle lever or may be a push button element or any other mechanism for actuating features of linear actuator (103). Linear actuator (103) may be a single-axis, rod style, belt style, stepper motor, or any other linear actuator style used to drive and retract elements linearly through the use of an electric driving force. Linear actuator (103) may include a screw such as a lead screw, screw jack, ball screw, and/or roller screw. Linear actuator (103) may include a hoist, winch, rack and pinion, chain drive, belt drive, rigid chain and/or rigid belt. Linear actuator (103) may include a cam, cam follower, and/or wedge.

As shown in FIG. 12, some versions of linear actuator (103) include a motor (105) for driving rotation of a nut element (107) having an elongated screw element (109) disposed therein. By rotating nut (107), screw element (109) is actuated linearly, depending on the direction of the rotation of nut (107). For example, if adjustment element (115) is actuated by the user in a first actuation, motor (105) rotates nut element (107) in a first direction, which in turn drives screw element (109) downwardly to raise the height of mobile workstation (101). If adjustment element (115) is actuated by the user in a second actuation, motor (105) rotates nut element (107) in a second direction, which in turn drives screw element (115) upwardly to lower the height of mobile workstation (101).

Mobile workstation (101) may include a force sensor (111) to monitor the resistance to the downward or upward pressure of the height adjustment features of mobile workstation (101). Force sensor (111) is configured to prevent mobile workstation (101) from inadvertently pressing down onto items such as a chair or examination table and otherwise avoid similar collisions or causing pinch hazards for users. For example, if a user actuates adjustment element (115) in such a manner to lower the height of mobile workstation (101) and a portion of mobile workstation (101) presses against a chair, force sensor (111) is configured to sense the tension or pressure exerted by the chair onto mobile workstation (101). Upon sensing the tension, some versions of mobile workstation (101) are configured to stop linear actuator (103), while some versions are configured to stop and reverse linear actuator (103) for at least a set amount of reverse linear distance.

Still other versions of mobile workstation (101) with electrically powered adjustable height may also have the ability to be programmed by users with pre-set height settings. Such a feature would allow users to quickly return a mobile workstation to a preferred height setting if, for example, another user had changed the height setting or a user desired to move from a sitting position to a standing position while using the mobile workstation. Methods and approaches to such programming are well known in the relevant art and will not be discussed in detail herein.

Mobile workstation (101) may be powered by a battery (117) or a power cable (119) plugged into a power source (not shown). Appropriate wiring and connections are provided within mobile workstation (101) for energizing linear actuator (103) and force sensor (111) and associated components via battery (117) and/or power cable (119).

III. Mobile Workstation Adjustability

As described above, some versions of mobile workstation (1) comprise top assembly (7), base assembly (9), and adjustment assembly (8) configured to selectively change the distance between top assembly (7) and base assembly (9). Some versions of adjustment assembly (8) comprise bottom shaft segment (29), wherein bottom shaft segment (29) is secured to base assembly (9). Some versions of adjustment assembly (8) comprise middle shaft segment (27), wherein middle shaft segment (27) is telescopically engaged with bottom shaft segment (29). Some versions of adjustment assembly (8) comprise top shaft segment (25), wherein top shaft segment (25) is secured to top assembly (7) and wherein top shaft segment (25) is telescopically engaged with middle shaft segment (27). Some versions of adjustment assembly (8) comprise upper pulley assembly (27). Some versions of adjustment assembly (8) comprise lower pulley assembly (49). Some versions of adjustment assembly (8) comprise a pulley, such as upper pully (51) or lower pully (65). Some versions of adjustment assembly (8) comprise a cable, such as first cable (57) or second cable (71), wherein the cable extends from a first end to a spaced apart second end, and wherein the cable is engaged with the pulley.

The descriptions, features, and examples provided herein illustrate a method comprising actuating adjustment assembly (8) of mobile workstation (1) to reduce a distance between top assembly (7) and base assembly (9) by retracting top shaft segment (25) of adjustment assembly (8) into middle shaft segment (27) of adjustment assembly (8) at a retract rate and simultaneously retracting middle shaft segment (27) into bottom shaft segment (29) of adjustment assembly (8) at the same retract rate.

IV. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A mobile workstation comprising: (a) a top assembly; (b) a base assembly; and (c) an adjustment assembly configured to selectively change the distance between the top assembly and the base assembly, the adjustment assembly comprising: (i) a bottom shaft segment, wherein the bottom shaft segment is secured to the base assembly, (ii) a middle shaft segment, wherein the middle shaft segment is telescopically engaged with the bottom shaft segment, (iii) a top shaft segment, wherein the top shaft segment is secured to the top assembly, wherein the top shaft segment is telescopically engaged with the middle shaft segment, (iv) an upper pulley assembly, and (v) a lower pulley assembly.

Example 2

The disclosure of Example 1 or any of the subsequent Examples, wherein the upper pulley assembly comprises: (a) a first pulley, wherein the first pulley is secured to the middle shaft segment; and (b) a first cable, wherein the first cable extends from a first end to a spaced apart second end, wherein the first cable is engaged with the first pulley.

Example 3

The disclosure of any of the previous or subsequent Examples, wherein the first end of the first cable is secured to the top shaft segment.

Example 4

The disclosure of any of the previous or subsequent Examples, wherein the top shaft segment comprises an upper plate, wherein the upper plate is movably disposed within the middle shaft segment, wherein the first end of the first cable is secured to the upper plate.

Example 5

The disclosure of any of the previous or subsequent Examples, wherein the second end of the first cable is secured to the bottom shaft segment.

Example 6

The disclosure of any of the previous or subsequent Examples, wherein the bottom shaft segment comprises a lower plate, wherein the second end of the first cable is secured to the lower plate.

Example 7

The disclosure of any of the previous or subsequent Examples, wherein the lower pulley assembly comprises: (a) a second pulley; and (b) a second cable, wherein the second cable extends from a first end to a spaced apart second end, wherein the second cable is engaged with the second pulley.

Example 8

The disclosure of any of the previous or subsequent Examples, wherein the first end of the second cable is secured to the top shaft segment.

Example 9

The disclosure of any of the previous or subsequent Examples, wherein the top shaft segment comprises an upper plate, wherein the upper plate is movably disposed within the middle shaft segment, wherein the first end of the second cable is secured to the upper plate.

Example 10

The disclosure of any of the previous or subsequent Examples, wherein the second end of the second cable is secured to the middle shaft segment.

Example 11

The disclosure of any of the previous or subsequent Examples, wherein the middle shaft segment comprises a middle plate, wherein the middle plate is movably disposed within the bottom shaft segment, wherein the first cable passes through the middle plate.

Example 12

The disclosure of any of the previous or subsequent Examples, wherein the second pulley is secured to the middle plate.

Example 13

The disclosure of any of the previous or subsequent Examples, further comprising a biasing element, wherein the biasing element is configured to bias the upper plate away from the middle plate.

Example 14

The disclosure of any of the previous or subsequent Examples, wherein the adjustment assembly is configured to withdraw the top shaft segment from the middle shaft segment at a withdraw rate, wherein the adjustment assembly is configured to withdraw the middle shaft segment from the bottom shaft segment at the withdraw rate.

Example 15

The disclosure of any of the previous or subsequent Examples, wherein the adjustment assembly is configured to retract the top shaft segment into the middle shaft segment at a retract rate, wherein the adjustment assembly is configured to retract the middle shaft segment into the bottom shaft segment at the retract rate.

Example 16

A mobile workstation comprising: (a) a top assembly; (b) a base assembly; and (c) an adjustment assembly configured to selectively change the distance between the top assembly and the base assembly, the adjustment assembly comprising: (i) a bottom shaft segment, wherein the bottom shaft segment is secured to the base assembly, (ii) a middle shaft segment, wherein the middle shaft segment is telescopically engaged with the bottom shaft segment, (iii) a top shaft segment, wherein the top shaft segment is secured to the top assembly, wherein the top shaft segment is telescopically engaged with the middle shaft segment, (iv) a pulley, and (v) a cable, wherein the cable extends from a first end to a spaced apart second end, wherein the cable is engaged with the pulley.

Example 17

The disclosure of any of the previous or subsequent Examples, wherein the first end of the cable is secured to the top shaft segment.

Example 18

The disclosure of any of the previous or subsequent Examples, wherein the second end of the cable is secured to the middle shaft segment.

Example 19

The disclosure of any of the previous or subsequent Examples, wherein the second end of the cable is secured to the bottom shaft segment.

Example 20

A method comprising actuating an adjustment assembly of a mobile workstation to reduce a distance between a top assembly and a base assembly by retracting a top shaft segment of the adjustment assembly into a middle shaft segment of the adjustment assembly at a retract rate and simultaneously retracting the middle shaft segment into a bottom shaft segment of the adjustment assembly at the retract rate.

V. Miscellaneous

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A mobile workstation comprising:

(a) a top assembly;

(b) a base assembly; and (c) an adjustment assembly configured to selectively change the distance between the top assembly and the base assembly, the adjustment assembly comprising:

(i) a bottom shaft segment, wherein the bottom shaft segment is secured to the base assembly, (ii) a middle shaft segment, wherein the middle shaft segment is slidably engaged with the bottom shaft segment, (iii) a top shaft segment, wherein the top shaft segment is secured to the top assembly, wherein the top shaft segment is slidably engaged with the middle shaft segment, wherein the top shaft segment comprises an upper plate, wherein the upper plate is movably disposed within the middle shaft segment, (iv) a first diverter assembly including a first cable diverter engaged with a first cable, wherein the first cable diverter is secured relative to the middle shaft segment, and wherein the first cable is secured relative to at least one of the bottom or top shaft segments, wherein the first cable extends from a first end to a spaced apart second end, wherein the first end of the first cable is secured to the upper plate of the top shaft segment, and (v) a second diverter assembly including a second cable diverter engaged with a second cable, wherein the second cable diverter is secured relative to the middle shaft segment, and wherein the second cable is secured relative to at least one of the bottom or top shaft segments.

2. The mobile workstation of claim 1, wherein the second end of the first cable is secured to the bottom shaft segment.

3. The mobile workstation of claim 2, wherein the bottom shaft segment comprises a lower plate, wherein the second end of the first cable is secured to the lower plate.

4. The mobile workstation of claim 3, wherein the second cable extends from a first end to a spaced apart second end.

5. The mobile workstation of claim 4, wherein the first end of the second cable is secured to the top shaft segment.

6. The mobile workstation of claim 1, further comprising a biasing element configured to bias the top shaft segment relative to the middle shaft segment.

7. The mobile workstation of claim 6, wherein the biasing element is engaged with the middle shaft segment.

8. The mobile workstation of claim 7, wherein the biasing element is engaged with the top shaft segment.

9. The mobile workstation of claim 6, wherein the biasing element configured to bias the top shaft segment away from the middle shaft segment.

10. The mobile workstation of claim 6, further comprising a lock assembly configured to selectively move from a locked position to an unlocked position, wherein the lock assembly in the locked position locks the adjustment assembly to fix the distance between the top assembly and the base assembly, and wherein the lock assembly in the unlocked position unlocks the adjustment assembly to change the distance between the top assembly and the base assembly.

11. The mobile workstation of claim 10, further comprising an adjustment rod secured relative to at least one of the bottom shaft segment, the middle shaft segment, or the top shaft segment, wherein the lock assembly in the locked position restricts the adjustment rod from moving relative to the lock assembly, and wherein the lock assembly in the unlocked position allows movement of the adjustment rod relative to the lock assembly.

12. The mobile workstation of claim 11, wherein the adjustment rod is offset from the biasing element.

13. A mobile workstation, comprising:

(a) a top assembly;

(b) a base assembly; and (c) an adjustment assembly configured to selectively change the distance between the top assembly and the base assembly, the adjustment assembly comprising:

(i) a plurality of shaft segments movably engaged with each other, the plurality of shaft segments including a middle shaft segment and a top shaft segment comprising an upper plate, wherein the upper plate is movably disposed within the middle shaft segment, (ii) a first cable diverter secured relative to the middle shaft segment and configured to change a direction of a first cable, wherein the first cable extends from a first end to a spaced apart second end, wherein the first end of the first cable is secured to the upper plate of the top shaft segment, (iii) a lock assembly configured to selectively move from a locked position to an unlocked position, wherein the lock assembly in the locked position locks the adjustment assembly to fix the distance between the top assembly and the base assembly, and wherein the lock assembly in the unlocked position unlocks the adjustment assembly to change the distance between the top assembly and the base assembly, (iv) an adjustment rod secured relative to at least one of the plurality of shaft segments, wherein the lock assembly in the locked position restricts the adjustment rod from moving relative to the lock assembly, and wherein the lock assembly in the unlocked position allows movement of the adjustment rod relative to the lock assembly, wherein at least a portion of the adjustment rod extends through the middle shaft segment.

14. The mobile workstation of claim 13, wherein the adjustment assembly further includes a second cable diverter secured relative to the middle shaft segment and configured to change a direction of a second cable.

15. The mobile workstation of claim 14, wherein the adjustment rod is secured relative to the middle shaft segment.

* * * * *